US006247330B1

(12) United States Patent
Ishikawa et al.

(10) Patent No.: US 6,247,330 B1
(45) Date of Patent: Jun. 19, 2001

(54) ABSORPTION TYPE REFRIGERATOR

(75) Inventors: Mitsuru Ishikawa; Nobuyuki Yuri; Hidetaka Kayanuma; Kohichi Miyashita, all of Saitama (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/409,379

(22) Filed: Sep. 30, 1999

(30) Foreign Application Priority Data

Oct. 12, 1998 (JP) ..... 10-289480
Oct. 27, 1998 (JP) ..... 10-305085

(51) Int. Cl.[7] ..... F25B 43/04
(52) U.S. Cl. ..... 62/475; 62/195
(58) Field of Search ..... 62/475, 474, 470, 62/195

(56) References Cited

U.S. PATENT DOCUMENTS 4,007,606 * 2/1977 Yoshio ..... 62/475
4,487,036 * 12/1984 Itoh et al. ..... 62/474
5,065,594 * 11/1991 Yo ..... 62/195
5,111,670 * 5/1992 Furukawa et al. ..... 62/475
5,636,526 * 6/1997 Plzak et al. ..... 62/475
6,055,821 * 5/2000 Song et al. ..... 62/195

FOREIGN PATENT DOCUMENTS

401167560 * 7/1989 (JP) .

* cited by examiner

*Primary Examiner*—Michael Buiz
*Assistant Examiner*—Chen-Wen Jiang
(74) *Attorney, Agent, or Firm*—Armstrong, Westerman, Hattori, McLeland & Naughton LLP

(57) ABSTRACT

For minimizing declination of the operational efficiency, hydrogen gas generated in an absorption type refrigerator is eliminated by reduction without exhausting to the outside. The hydrogen gas $H_2$ remains close to the level surface 93 of a refrigerant in a condenser 9 is transferred together with a refrigerant vapor via an extraction pipe 92 to a condenser tank 91. The condenser tank 91 is equipped with a heated metal oxide which is allowed to come into direct contact with the hydrogen gas for carrying out its reduction. Accordingly, the hydrogen gas is eliminated and a trace of water is generated. The water is then returned back via the extraction pipe 92 to the condenser 9. As a result, the elimination of the hydrogen gas is successfully carried out while the water generated stays in the system, whereby the content of water in the refrigerant can be maintained to a desired level.

14 Claims, 7 Drawing Sheets

Fig. 7
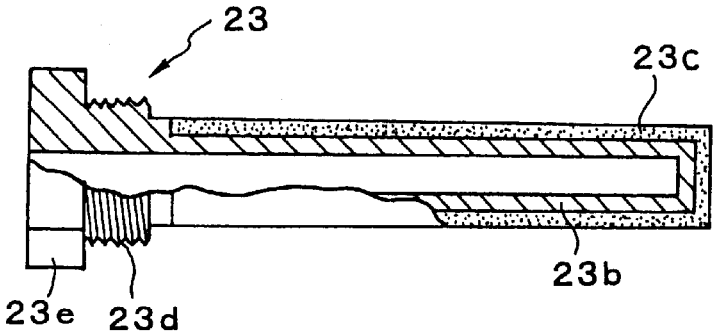
Fig. 8
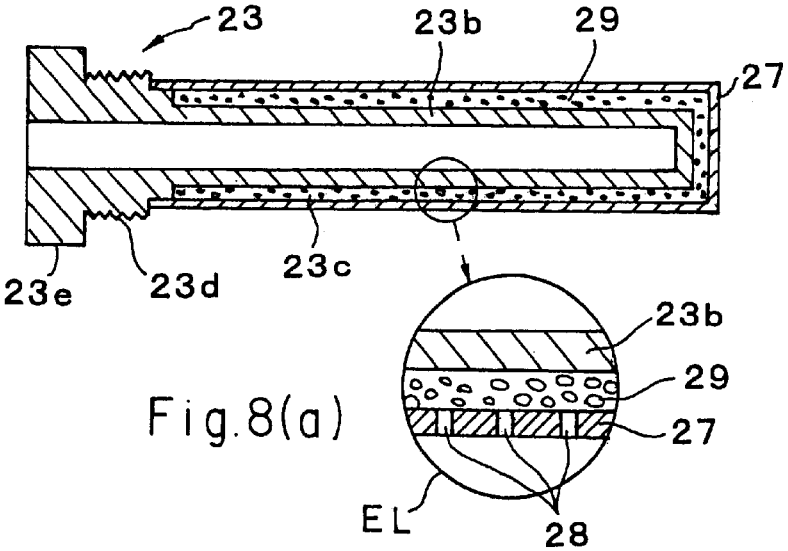
Fig.8(a)
Fig. 10
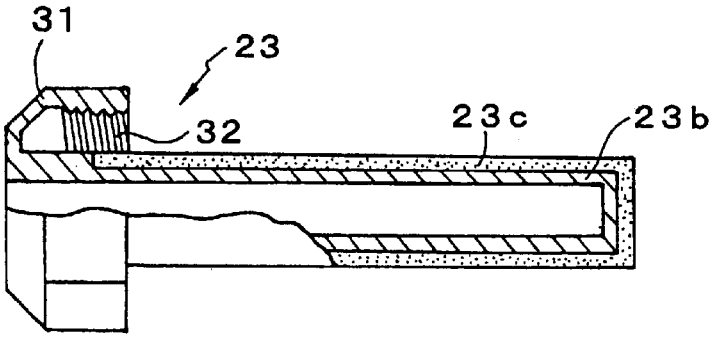

ABSORPTION TYPE REFRIGERATOR

BACKGROUND OF THE INVENTION

1. Field of the Invention

The present invention relates to an absorption type refrigerator and particularly, to an absorption type refrigerator having a removing apparatus for removing uncondensed hydrogen gas generated in the refrigerator.

2. Description of the Related Art

Absorption type refrigerators operated in absorption refrigeration cycles are known for use as cooling systems. Also, since its advantageous features including a higher energy efficiency during the operation have been focused, a specific class of the absorption type refrigerator in which heat pumped up from the outside air by an evaporator is also utilized to carry out a heat-pump (thermodynamic) heating operation is now anticipated to meet the market demand. For example, such a type of absorption type cool/hot water supply system is proposed in Japanese Patent Publication Hei 6-97127 which can run in three different modes: a cooling mode, a heating mode by heat-pump (thermodynamic cycle) operation, and a direct flame heating mode by direct burner (boiler) operation.

The absorption type refrigerator performs an absorption refrigerating cycle operation under a highly vacuum condition, hence causing direct contact reaction to be initiated between some components of a refrigerant and the metallic materials of a refrigerant conduit and between said components and the corrosion inhibitor thus to generate a small amount of uncondensed gas such as hydrogen gas. The presence of such an uncondensed gas declines the vacuum level in the absorber or the evaporator which must be maintained in a high level of vacuum, thus lowering the efficiency of the cooling and heating operation. It is hence necessary to carry out, at predetermined intervals, a series of maintenance jobs for exhausting the uncondensed gas using an extracting means such as a vacuum pump.

Such apparatuses for exhausting the uncondensed gas generated in absorption type refrigerators are disclosed in Japanese Patent Laid-open Publication Hei 8-121911 and 5-9001. Those apparatuses are designed to transfer the uncondensed gas separated from a refrigerant to a hydrogen exhausting conduit made of a palladium pipe heated for exhausting the gas to the atmosphere using the selective permeability of palladium.

However, the absorption type refrigerators equipped with an uncondensed gas exhausting apparatus have the following disadvantages. In the absorption type refrigerator using an alcohol refrigerant such as alcohol fluoride for absorption refrigerating cycles, it is known to mix some water and the refrigerant together for minimizing corrosion to metallic materials of the refrigerant piping. In that case, water added to the refrigerant may react on aluminum of the refrigerant piping thus to generate a small amount of hydrogen gas which has to be removed. The generation of hydrogen gas is caused by both anode reaction and cathode reaction: the anode reaction is expressed as $Al \rightarrow Al^{3+}+3e^{-}$ and $Al^{3}+3OH \rightarrow AlOOH.H_2O$ (hydration of aluminum ion (deposition of boehmite layer)), the cathode reaction as $3H+3e \rightarrow 3/2H_2$ (generation of hydrogen).

The conventional uncondensed gas exhausting apparatuses disclosed in the Publications are adapted for exhausting the hydrogen gas to outside of the apparatus and thus its construction to be maintained at a higher air-tightness becomes complex. Also, the water in the refrigerant is gradually decreased and its substantial amount needed for minimizing (suppressing) the corrosion will hardly be reserved. Moreover, they allow their hydrogen exhausting piping and/or a means (e.g. a sleeve member) for housing the hydrogen exhausting piping to extend out from the gas extracting body and may hence be complicated in the outer configuration or may interfere with adjacent apparatus.

SUMMARY OF THE INVENTION

It is an object of the present invention to provide an absorption type refrigerator capable of removing undesired uncondensed gas while the content of water in the refrigerant is maintained at an appropriate level.

According to the present invention, an absorption type refrigerator having an evaporator in which a refrigerant is stored, an absorber for absorbing a refrigerant vapor generated in the evaporator with the use of an absorbent solution, a regenerator for heating the absorbent solution to extract the refrigerant vapor, and a condenser for condensing the refrigerant vapor extracted in the regenerator and returning it to the evaporator is characterized in that the refrigerant is an alcohol refrigerant and a reduction body is provided which comprises a hydrogen removing agent and a heating means for heating the agent to carry out the reduction with hydrogen gas generated during the absorption refrigerating cycles.

As characterized, the hydrogen gas generated through the reaction between the alcohol refrigerant and an aluminum structure of the refrigerant passage reacts on the hydrogen removing agent and is thus eliminated. As the hydrogen gas is eliminated, declination of the efficiency of operation due to decrease of the vacuum level in each of the condenser, the evaporator, the absorber, and the refrigerant passages will be avoided. Also, the water thus generated is returned back to the refrigerant passage which is directly communicated with the reduction body, the content of water in the refrigerant can be maintained to a desired level. Moreover, the heating means is securely held by the holding means equipped with the hydrogen removing agent and when heated, can cause the hydrogen removing agent to accelerate the elimination of hydrogen gas.

Also, according to the present invention, an absorption type refrigerator wherein the heating means is of a bar-like shape and a holding means for holding the heating means is provided in the reduction body, which is of a cylindrical shape having one end thereof opened to accept the heating means and an outer side thereof provided with a holding surface for the hydrogen removing agent, and is arranged to expose the hydrogen removing agent to the space directly communicated with the level surface of the refrigerant.

BRIEF DESCRIPTION OF THE DRAWINGS

FIG. 7 is a cross sectional view of a heater holder in the hydrogen removing apparatus;

FIG. 8 is a cross sectional view of the condenser equipped with the heater holder;

FIG. 10 is a cross sectional view of another modification of the heater holder;

DETAILED DESCRIPTION OF THE PREFERRED EMBODIMENTS

Figure 14:
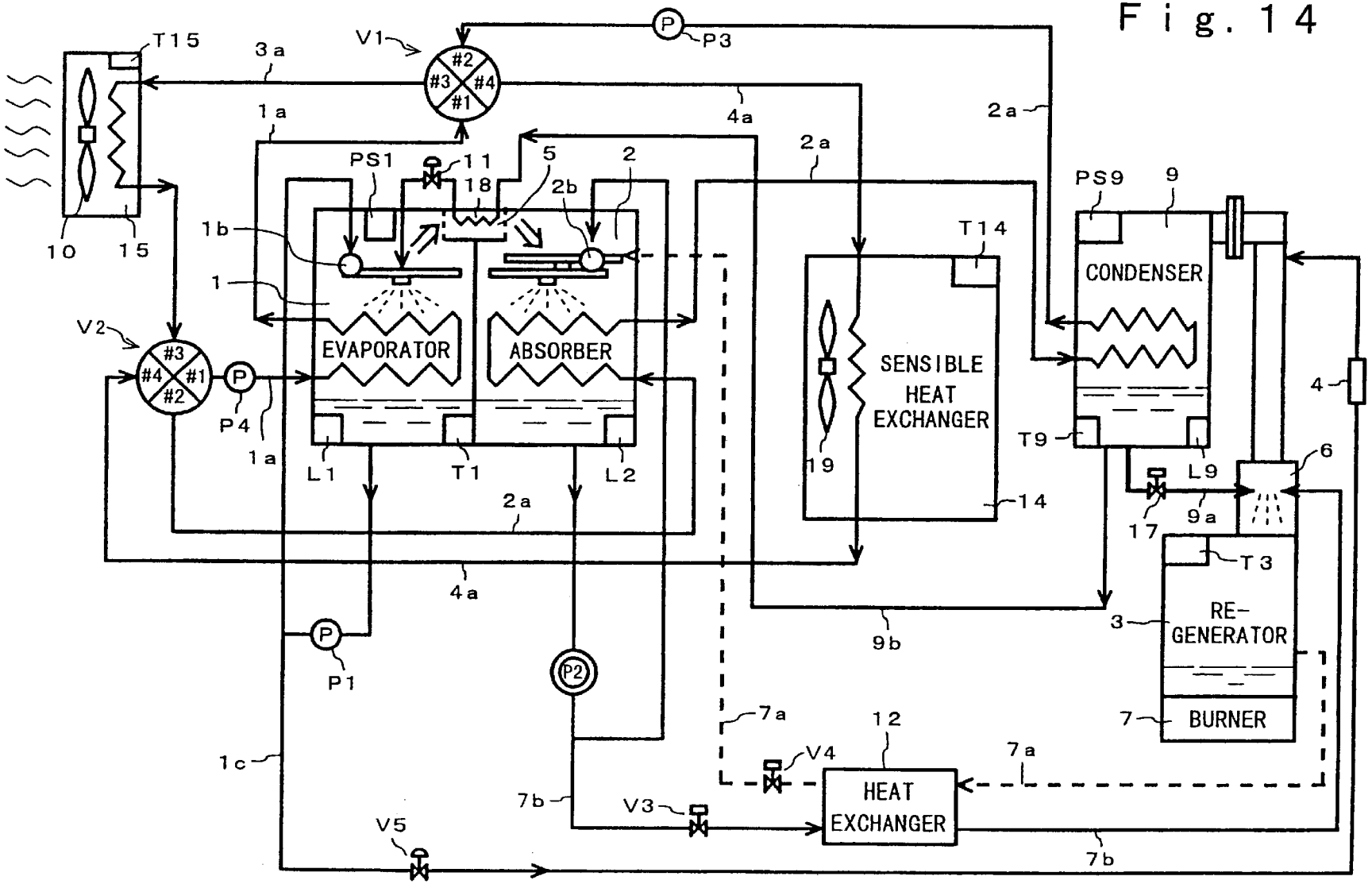
FIG. 14 is a circuitry diagram showing an arrangement of the absorption type refrigerator of the embodiment of the present invention.

A preferred embodiment of the present invention will be described in more detail referring to the accompanying drawings. FIG. 14 is a block diagram showing a primary part of an absorption refrigerating/heating apparatus of the embodiment of the present invention. An evaporator 1 accommodates a refrigerant of fluoride alcohol, such as trifluoroethanol (TFE), while an absorber 2 accommodates a solution of DMI derivative, such as dimethylimidazolidinon, which contains an absorbent. The refrigerant is not limited to fluoride alcohol but may be an appropriate agent of which the nonfreezing range is wide. The solution is not limited either to the DMI derivative and it may be any other absorbent solution which is wide in the nonfreezing range, being higher than TFE in atmospheric temperature boiling point and having an enough power to absorb TFE.

The evaporator 1 and the absorber 2 are fluidly communicated to each other by a (refrigerant) vapor passage 5. When the evaporator 1 is kept under a low pressure condition of e.g. 30 mmHg, the refrigerant is vaporized therein and moves via the vapor passage 5 into the absorber 2, as denoted by the double-line arrows. The refrigerant vapor is then absorbed by the absorbent in the absorber 2 thus causing an absorption freezing action.

A cooler 18 is provided for heating and evaporating a remaining mist (of the refrigerant) in the refrigerant vapor and for decreasing the temperature of the refrigerant received from the condenser 9.

When a burner 7 is lit to heat up a regenerator 3 for increasing the concentration of the absorbent solution in the absorber 2, the absorbent absorbs the refrigerant vapor in the absorber 2 and the evaporation of the refrigerant in the evaporator 1 is accelerated hence cooling down the interior of the evaporator 1 with the latent heat of the refrigerant evaporation. The burner, the regenerator, and the concentration of the absorbent solution will be described later in more detail. A tube or pipe 1*a* for passing a chilled water is mounted to run through the evaporator 1 by using a pump P4. The tube 1*a* is connected at one end (the exit side in the embodiment shown) to the No. 1 opening of a first four-way valve V1 and at the other end (the entrance side in the embodiment) to the No. 1 opening of a second four-way valve V2. The refrigerant is fed by the action of a pump P1 to a spraying means 1*b* mounted in the evaporator 1 for being sprayed over the tube 1*a* in which the chilled water runs. The refrigerant deprives the chilled water in the tube 1*a* of heat and turns to a vapor which passes via the vapor passage 18 into the absorber 2. Consequently, the temperature of the chilled water is more declined.

The refrigerant in the evaporator 1 is driven by the pump P1 to the spraying means and, as will be described later, its portion is passed through the filter 4 and transferred to the rectifier 6 as a vapor/liquid contact fluid (referred to as a bleed hereinafter). A flow control valve V5 is provided between the evaporator 1 and the filter 4. The chilled water running in the tube 1*a* may preferably be either an ethylene glycol or propylene glycol water solution.

As the refrigerant vapor is absorbed by the solution in the absorber 2, the absorption heat increases the temperature of the solution. The lower the temperature and the higher the concentration of the solution, the greater the absorbing capability of the solution will be. For attenuating the temperature increase of the solution, a tube 2*a* is provided in the absorber 2 for passing a flow of cooling water. The tube 2*a* is connected at one end (the exit side in the embodiment shown) via a condenser 9 and a pump P3 to the No. 2 opening of the first four-way valve V1 and at the other end (the entrance side) to the No. 2 opening of the second four-way valve V2. Preferably, the cooling water running along the tube 2*a* is the same as the chilled water which runs across the tube 1*a* in properties or constitution.

The absorbent solution is fed by the action of the pump P2 to a spraying means 2*b* mounted in the absorber 2 for being sprayed over the tube 2*a*. Consequently, the solution is cooled down by the cooling water running along the tube 2*a*. Simultaneously, the cooling water deprives the solution of heat and its temperature will increase. As the solution in the absorber 2 has absorbed the refrigerant vapor, the concentration of the absorbent drops thus lowering the absorbing capability of the solution.

The diluted solution which has absorbed the refrigerant vapor in the absorber 2 is passed via a tube 7*b* and a control valve V3 to the rectifier 6 and the regenerator 3 by the pump P2. The regenerator 3 is provided with the burner 7 for heating up the diluted solution. The burner 7 may be a gas burner or any other heating means. The solution is heated by the burner 7 and the concentration of the absorbent is increased as the refrigerant vapor is separated. The resultant (concentrated) solution is returned via a tube 7*a* and a control valve V4 to the absorber 2 where it is sprayed over the tube 2*a* by the spraying means 2*b* and pump P2.

When the diluted solution conveyed to the regenerator 3 is heated up by the burner 7, a refrigerant vapor is generated. Most of the absorbent solution is separated from the refrigerant vapor in the rectifier 6 and thus, the refrigerant vapor at a higher purity is fed to the condenser 9. The refrigerant vapor is then cooled down and condensed to a liquid in the condenser 9, and returned back via the pre-heater 18 and the reducing valve 11 to the evaporator 1. The refrigerant is sprayed over the conduit 1*a*.

Although the purity of the refrigerant fed back from the condenser 9 is fairly high in the evaporator 1, it may or must gradually be declined because a very small amount of the absorbent in the circulated vapor is accumulated during a long period of the cycle operation. For recovering the purity of the refrigerant, a small portion of the refrigerant from the evaporator 1 is sent through the valve 5 and the filter 4 to the rectifier 6 where it is mixed with the refrigerant vapor from the regenerator 3. The filter 4 is used for preventing filler tubes of the rectifier 6 from being fouled with dirt and/or rust in the absorbent solution which may cause degradation of the functional operation.

A heat exchanger 12 is provided in the middle way of the tubes 7*a* and 7*b* which respectively connect the absorber 2 and the rectifier 6. The absorbent solution at high concentration and high temperature which runs along the tube 7*a* from the regenerator 3 is subjected to a heat exchanging action in the heat exchanger 12 with the diluted solution which runs along the tube 7*b* from the absorber 2, hence being cooled before it is fed to the absorber 2 where it is sprayed. In reverse, the diluted solution is preheated by the action of the heat exchanger 12 and passed to the rectifier 6. This will surely improve the thermal efficiency in the apparatus. In addition, another heat exchanger (not shown) may be provided for transferring heat from the concentrated solution to the cooling water which runs along the tube 2*a* from the absorber 2 or the condenser 9. Accordingly, the temperature of the concentrated solution returned to the absorber 2 will be reduced further while the temperature of the cooling water will be increased.

A sensible heat exchanger 14 is also provided with a tube 4*a* for heat exchange between the cooling water or the chilled water and the outside air and an indoor unit 15 is provided with a tube 3*a*. The tubes 3*a* and 4*a* are connected at one end (the entrance side in the embodiment shown) to the No. 3 and No. 4 openings of the first four-way valve V1, respectively, and at the other end (the exit side) to the No. 3 and No. 4 openings of the second four-way valve V2, respectively. The indoor unit 15 is located in a room to be cooled or heated and includes a fan 10 used in common for blowing out either cooling air and heating air from its blowing window (not shown). The sensible heat exchanger 14 is normally placed in the outdoor and includes a fan 19 for forcedly exchanging of heat with the outside air.

The evaporator 1 is provided with a level sensor L1 for detecting the amount of the refrigerant and a temperature sensor T1 for detecting the temperature of the refrigerant. The absorber 2 is equipped with a level sensor L2 for detecting the amount of the solution. The condenser 9 is provided with a level sensor L9 for detecting the amount of condensed refrigerant, a temperature sensor T9 for detecting the temperature of the refrigerant, and a pressure sensor PS9 for detecting the pressure in the condenser 9.

The sensible heat exchanger 14 is provided with a temperature sensor T14 for detecting the temperature of the outside air, the indoor unit 15 is provided with a temperature sensor T15 for detecting the temperature of a room which is air-conditioned, and the regenerator 3 is provided with a temperature sensor T3 for detecting the temperature of the solution. A temperature sensor T6 for detecting an atmosphere temperature or the temperature of refrigerant vapor rectified by the rectifier 6 is provided at the top of the rectifier 6.

In the cooling operation, the first and the second four-directional valves V1 and V2 are actuated so that their No. 1 and No. 2 openings communicate with the No. 3 and No. 4 openings respectively. This allows the chilled water cooled down by spraying the refrigerant over the conduit 1*a* to run into the conduit 3*a* of the indoor unit 15 for cooling the room.

In the heating operation, the first V1 and the second four-directional valve V2 are switched so that their No. 1 and No. 2 openings communicate with the No. 4 and No. 3 openings respectively. This allows the cooling water heated up in the conduit 2*a* to be driven by the pump P3 into the conduit 3*a* of the indoor unit 15 for heating the room.

When the temperature of the outside air drops down to an extreme level during the heating operation, pumping the heat from the outside air by the sensitive heat exchanger 14 becomes difficult hence declining the heating capability. For compensation, a return passage 9*a* and an open/close valve 17 are provided in a combination for bypassing between the condenser 9 and the regenerator 3 (or the rectifier 6). As the pumping the heat from the outside air has become hard, the absorption and refrigeration cycle is ceased and the vapor generated by the regenerator 3 is circulated to and from the condenser 9. In the condenser 9, the heat produced with the burner 7 is efficiently transferred by the direct heat-up operation to the cooling water in the conduit 2*a*, thus improving the heating capability.

Figure 1:
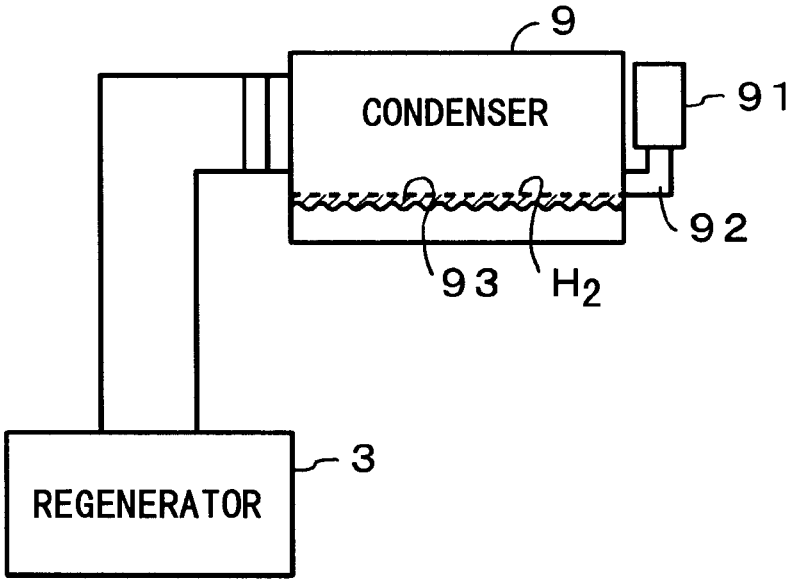
FIG. 1 is a schematic view showing a primary part of an absorption type refrigerator of a first embodiment.

A hydrogen removing apparatus installed in the cooling and heating system will now be explained. FIG. 1 is a schematic view showing the hydrogen removing apparatus in the cooling and heating system of the embodiment. As shown, the condenser 9 is accompanied with a condenser tank 91. The condenser 9 and the condenser tank 91 are communicated to each other by an extraction pipe (a passage means) 92. The extraction pipe 92 is located so that it is opened slightly above the level surface 93 of the refrigerant in the condenser 9. A hydrogen removing assembly which acts as a reduction body with metal oxide and can be heated by a heater (a heating means) is mounted in the condenser tank 91 (as will be explained later in more detail referring to FIGS. 2 and 3). Such metal oxide may be a single oxide of transition metal or a mixture of different transition metal oxides. For example, preferably selected is $NiO_2$ or a mixture of $Cu_2O_3$, $MnO_2$, $Al_2O_3$, and $NiO_2$ as a main component.

The reaction between water in the refrigerant and aluminum which is one of the main structural members of the cooling and heating system, takes place in the condenser 9 where both the temperature and the pressure are high. The reaction produces hydrogen gas $H_2$ which is dispersed throughout the interior of the condenser 9 in a pause mode and remains close to the level surface 93 of the refrigerant, as shown in FIG. 1, due to a flow of the refrigerant vapor in the condenser 9 when the system is running. The remaining hydrogen gas $H_2$ is dispersed by the effect of concentration gradation and transferred into the condenser tank 91 where the gas $H_2$ comes in direct contact with the metal oxide heated by the heater. Consequently, the reduction of the metal oxide is initiated thus producing water and eliminating the hydrogen gas $H_2$. More specifically, the chemical reaction expressed by the following formula f1 involves.

$$MOX+XH_2=M+XH_2O \quad \text{(f1)}$$

Note that M is a transition metal and X is a constant. The generated water is then transferred via the extraction pipe 92 to the condenser 9.

As the elimination of the hydrogen gas in the condenser 9 involves the generation of water, it permits the content of water in the refrigerant conveyed through the piping not to be declined. Accordingly, the water contained in the refrigerant for minimizing the corrosion to metal materials of the refrigerant piping can be maintained to an appropriate level.

Figure 2:
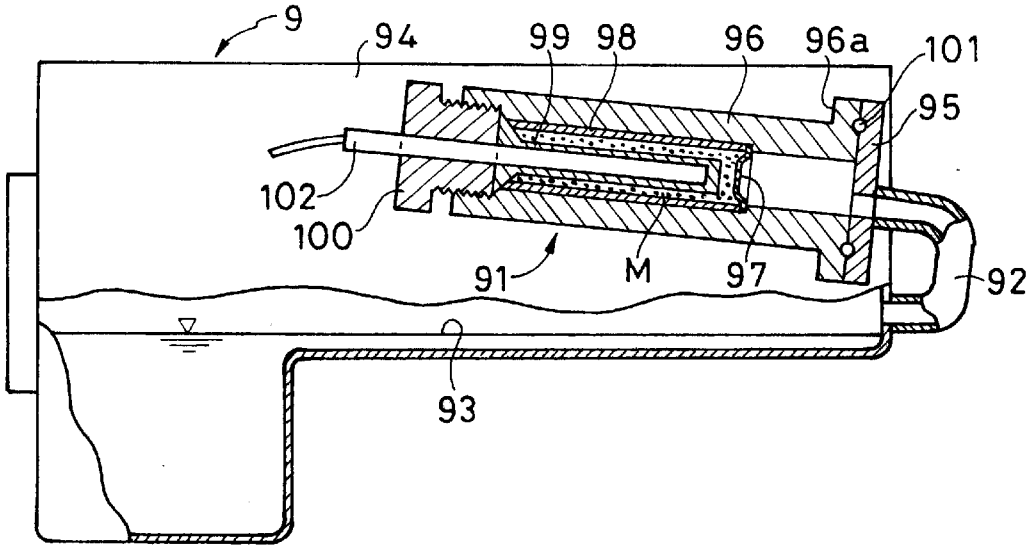
FIG. 2 is a front view of a condenser of the absorption type refrigerator of the first embodiment.
Figure 3:
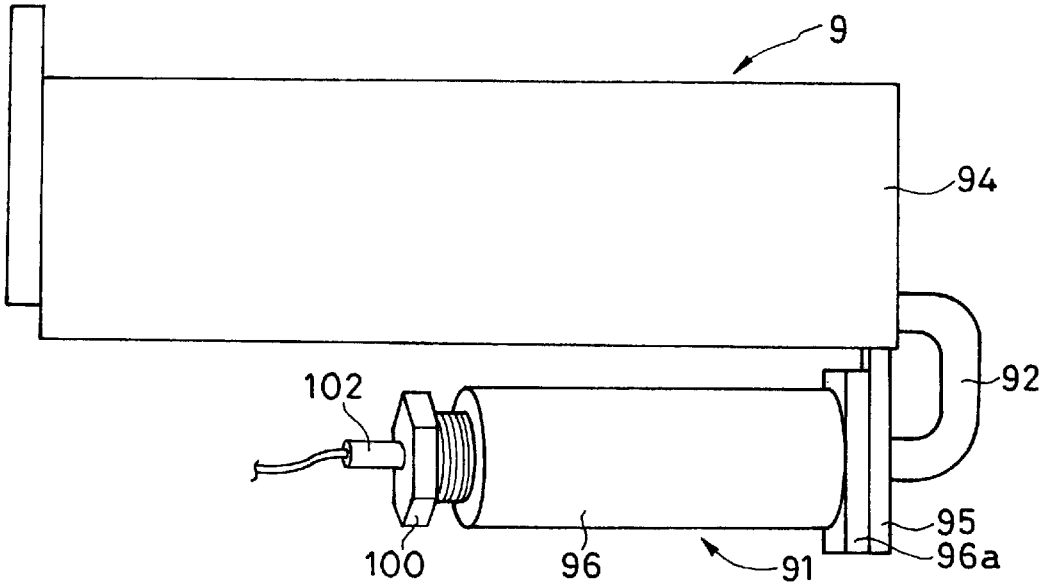
FIG. 3 is a plan view of the condenser of the absorption type refrigerator of the first embodiment.

The hydrogen removing assembly is now explained. FIG. 2 is a front view showing a primary part of the condenser 9 and the condenser tank 91 communicated to the condenser 9 and FIG. 3 is a plan view of the same, where like numerals denote like components as or identical components to those of FIG. 1. As shown, a bracket 95 is mounted to the front side of a housing 94 of the condenser 9. The bracket 95 is joined by bolts (not shown) to a flange 96*a* of a cylindrical housing 96. A tube 98 closed at one end with a (net) filter 97 is mounted in the cylindrical housing 96. A heater holder 99 is mounted in the center of the tube 98 for holding a heater 102. The heater holder 99 and the tube 98 are securely held in the cylindrical housing 96 with a cap 100 which has a male thread provided on the outer surface thereof and screwed into a female thread provided on the inner side at one end of the cylindrical housing 96. An O-ring 101 is disposed as a sealing member between the bracket 95 and the flange 96*a*. The space between the tube 98 and the heater holder 99 is filled with a powder of metal oxide M.

The heater 102 is inserted into the heater holder 99 through a hole provided in the center of the cap 100 and can be removed when desired. For example, the heater 102 may be installed in the heater holder 99 only once a week when a maintenance job for eliminating the hydrogen gas is carried out an d otherwise remains removed. It is a good idea that the heater 102 is o f a known type capable of applying a flow of electric current to its resistance body for heating and preferably designed for heating up the heater holder 99 to a surface temperature of 130 to 1600° C.

The hydrogen gas charged from the extraction pipe 92 to the front of the filter 97 passes through the filter 97 and co m e s into direct contact with the metal oxide in the tube 98. As a result, the foregoing reaction generates water which flows down via the extraction pipe 92 to the condenser 9.

Although the metal oxide is a powder form in this embodiment, it is not of limitation. For example, the heater holder 99 is coated at its outer surface with a layer of the metal oxide for direct contact with the hydrogen gas. In this case, the filter 97 can be eliminated. The metal oxide may be a single substance such as described above or it may be mixed with a very small amount of an additive such as a compound which has a catalyst function for accelerating the reaction between the metal oxide and the hydrogen gas. Although the heating means for stimulating the elimination of the hydrogen gas $H_2$ is the heater 102 in the embodiment, it may be possible to utilize the heat of condensation in the condenser 9 if it is unnecessary to shorten the duration of the operation.

Figure 4:
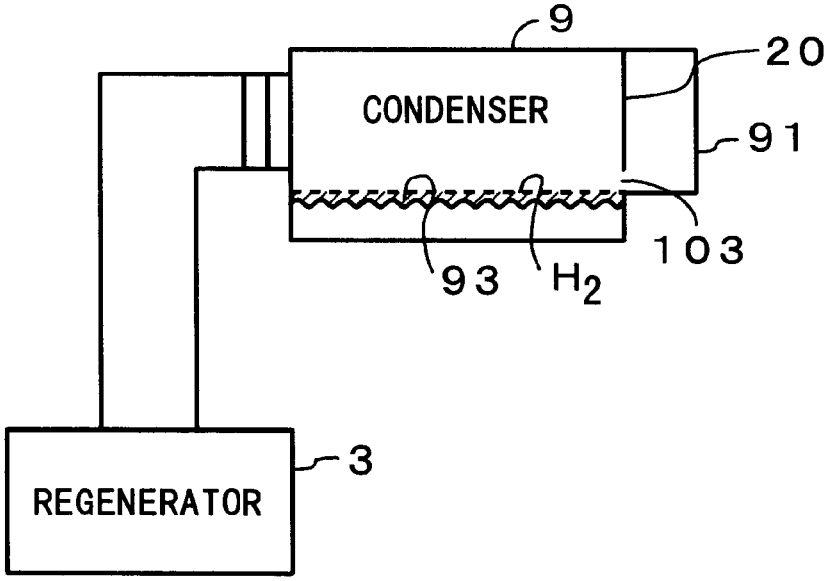
FIG. 4 is a schematic view showing a primary part of an absorption type refrigerator of a second embodiment.

The connection member between the condenser 9 and the condenser tank 91 is not limited to the pipe and any modification will be made. FIG. 4 is a schematic view showing a modification of the connection member between the condenser 9 and the condenser tank 91. As shown, an aperture 103 is provided as a passage means between the condenser 9 and the condenser tank 91 which are adjoined directly to or separated by a partition from each other. All of the refrigerant vapor, the refrigerant, the hydrogen gas, and the generated water can pass through the aperture 103.

Figure 5:
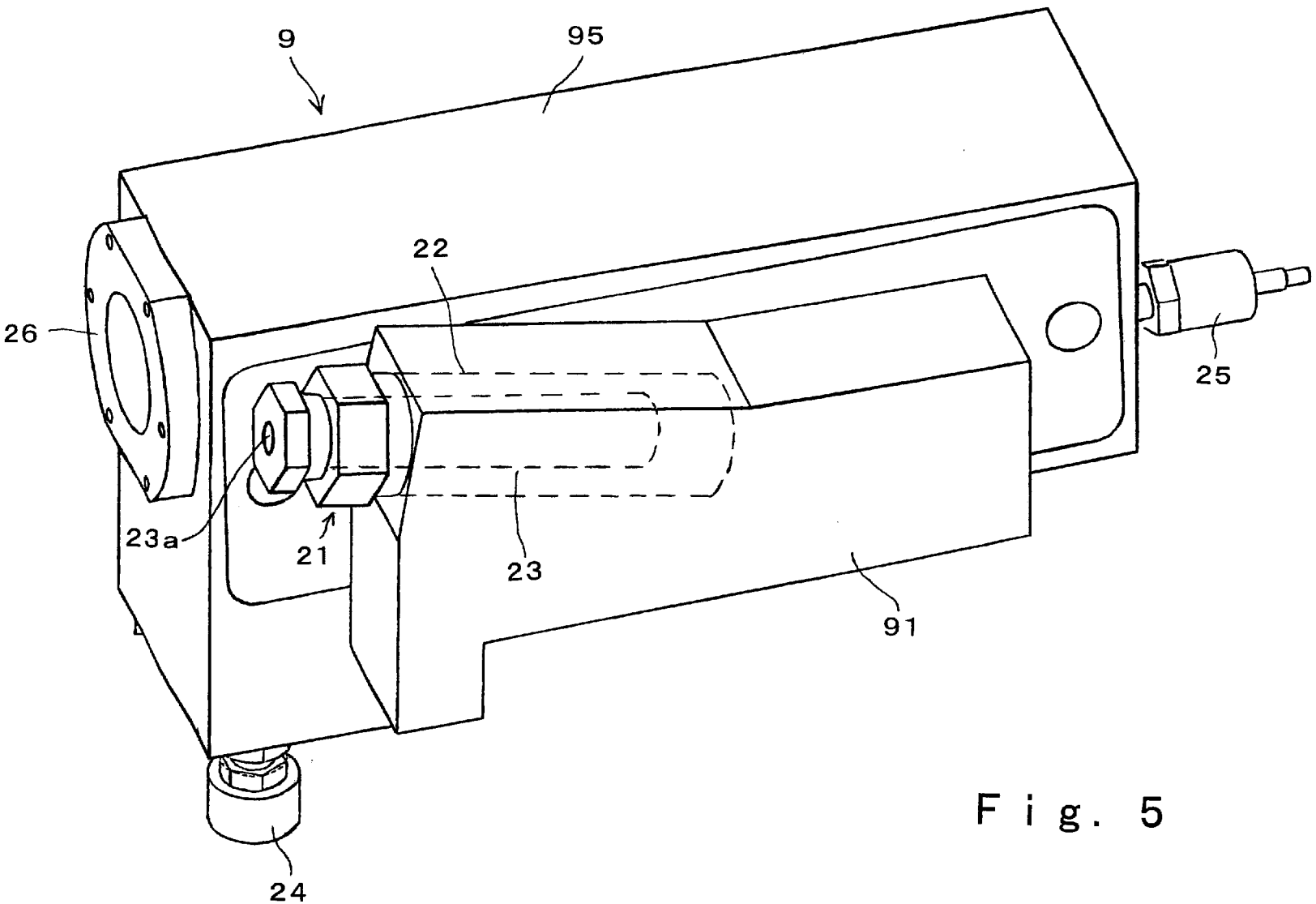
FIG. 5 is a perspective view of a condenser equipped with a hydrogen removing apparatus.
Figure 6:
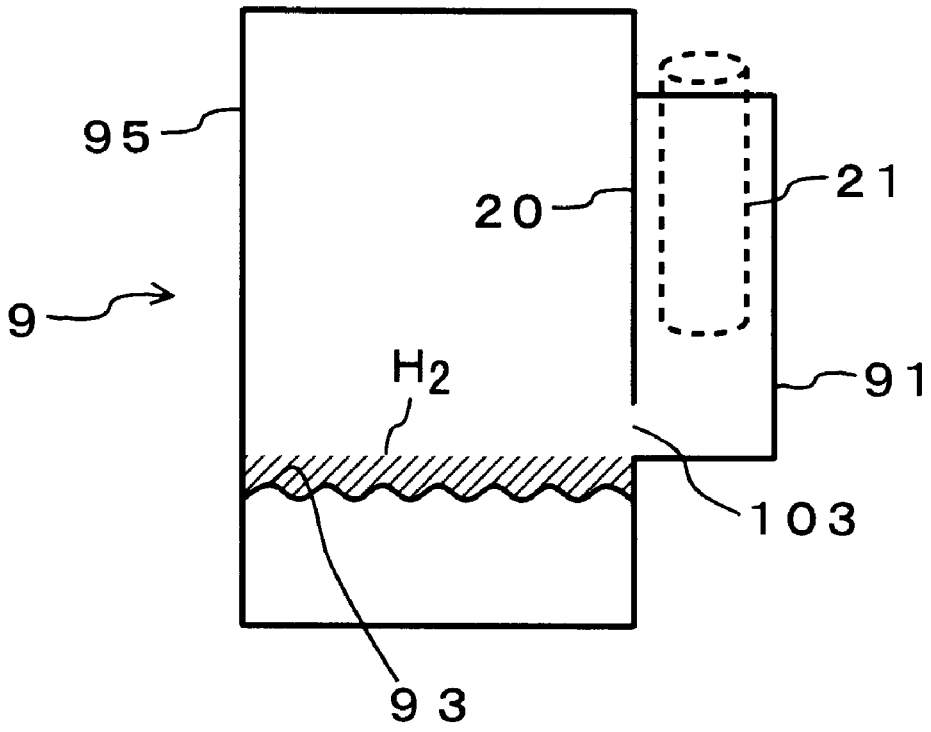
FIG. 6 is a cross sectional view of a modification of the heater holder.

The hydrogen gas removing apparatus shown in FIG. 4 is now explained in more detail. FIG. 5 is a perspective view of the condenser accompanied with the hydrogen gas removing apparatus and FIG. 6 is a cross sectional view of the same. Referring to both the figures, like components are denoted by same numerals. The condenser 9 is comprised of the condenser chamber 95 and the condenser tank or hydrogen gas removing tank 91. The hydrogen gas removing tank 91 is separated from the condenser chamber 95 by a partition 20 as two are integrally fabricated by welding, for example. The aperture 103 in the partition 20 permits any fluid to flow between the hydrogen gas removing tank 91 and the condenser chamber 95. The hydrogen gas $H_2$ generated by alkoxide reaction is held as stuck close to the level surface 93 of the refrigerant by the flow of the refrigerant vapor in the condenser 9. The hydrogen gas $H_2$ is dispersed throughout the condenser 9 while the system is not running. The aperture 103 is located slightly above the level surface 93 of the refrigerant in the condenser chamber 95 so that the hydrogen gas $H_2$ standing on the level surface 93 is dispersed and moved, due to the concentration gradation, into the space in the hydrogen gas removing tank 91.

A hydrogen gas eliminating assembly 21 for removing the hydrogen gas $H_2$ received is mounted in the hydrogen gas removing tank 91. The hydrogen gas eliminating assembly 21 comprises a heater holder 23 attached to a recess 22 provided inwardly in the hydrogen removing tank 91 and tightened by screwing to a female thread formed in the recess 22 and a heater (not shown) inserted into a hole 23*a* of the heater holder 23 for installation. The heater holder 23 has a reduction body provide with the material which react with the hydrogen gas $H_2$ to produce water for eliminating the hydrogen gas $H_2$. The heater holder 23 and its reduction body will be explained later in more detail referring to FIG. 7.

Mounted on the wall surfaces of the condenser 9 are a joint 24 to the circulating passage 9*a* for supplying the refrigerant to the regenerator 3 (or the rectifier 6), a joint 25 to the conduit 2*a* for conveying the cooling water, and a joint 26 to the rectifier 6.

The heater holder 23 is now explained referring to a cross sectional view of FIG. 7. As shown, the heater holder 23 comprises a bottomed cylindrical base 23*b* made of stainless steel (e.g. SUS 304) and the reduction body 23*c* extending around the base 23*b*. The base 23*b* has a male thread 23*d* screwed into the female thread of the recess 22 and a head 23*e* shaped for matching the shape of a tightening tool such as a spanner or a wrench.

The reduction body 23*c* may be formed out of, for example, a sintered metal oxide (a hydrogen eliminating agent) which can cap the base 23*b*. The metal oxide may be an oxide of transition metal or a mixture of transition metal oxides. For example, the metal oxide is preferably $NiO_2$ or a mixture of $Cu_2O_3$, $MnO_2$, $Al_2O_3$, and $NiO_2$ as a main component. The reduction body 23*c* is not limited to the metal oxide formed but may be fabricated from a group of sintered pieces or a powder of metal oxide. The pieces or powder may be secured to the base 23*c* by a filter means which is a net or a tube with a multiplicity of through holes and can wrap the entirety of the base 23*c*.

FIG. 8 is a cross sectional view showing a primary part of the filter means securing the pieces or powder of metal oxide on the base 23*c*. As shown, the filter 27 is a tube with a multiplicity of through holes 28 (illustrated in more detail in an enlarged view EL). The powder or pieces of metal oxide 29 are held between the tube 27 and the base 23*b* thus constituting the reduction body 23*c*. The hydrogen gas $H_2$ enters through the holes 28 and comes into direct contact with the powder or pieces of metal oxide 29.

Figure 9:
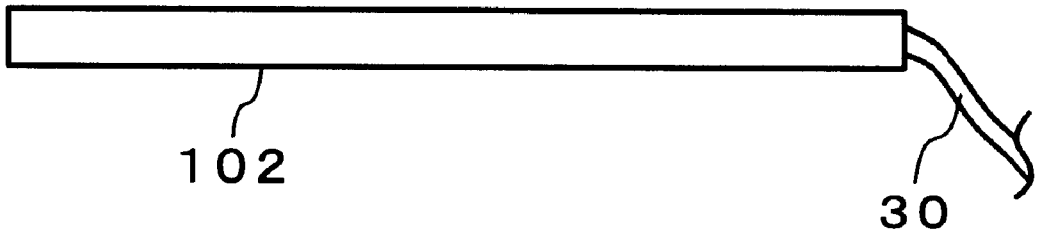
FIG. 9 is an external view of a bar-shaped heater.

FIG. 9 is an external view of a heater which can be inserted into the heater holder 23 for use. The heater 102 of a bar shape has a resistance body (not shown) coated with an insulating layer (a sheath). An electric current is introduced via the leads 30 to the resistance body. The bar heater 102 is installed in the heater holder 23 when used and will not always be held in the heater holder 23 as is removed out when not used.

In operation, the hydrogen gas $H_2$ flows into the hydrogen removing tank 91 through the aperture 103 to react on the metal oxide of the reduction body 23*c* mounted on the heater holder 23 thus reducing the metal oxide to water and eliminating the hydrogen gas. More particularly, the chemical reaction denoted by the formula f1 takes place.

FIG. 10 is a cross sectional view showing a modified form of the heater holder 23. As shown, the heater holder 23 has a flange 31 provided on the open end thereof. The flange 31 is turned down towards the sealing side or bottom of the heater holder 23 to form a cap-like shape. The cap-like shape of the flange 31 has a female thread 32 provided in the inner side thereof. The female thread 32 of the heater holder 23 is adapted to fit with a male thread provided on a lip outwardly extending from the opening of the recess 22 in the tank 91.

As the heater holder 23 with the female or male thread is airtightly secured to the hydrogen removing tank 91, the hydrogen gas can be eliminated within the hydrogen gas removing tank 91 maintained at air-tightness. It would be understood that the thread connection between the heater holder 23 and the recess 22 is protected with a length of sealing tape for increasing the air-tightness.

The alkoxide reaction mainly occurs in the condenser 9 where the temperature and the pressure are both high. For that reason, the hydrogen removing tank 91 is provided integral with the condenser 9 in the embodiments. But, such an integral structure is not of limitation and the tank 91 may be located in another place while it is communicated with the passage of the refrigerant.

In the embodiment, the heater holder 23 is joined by the thread connection to the hydrogen removing tank 91 for ensuring the air-rightness. It is however possible that the head 23*e* of the heater holder 23 has a through hole provided therein for accepting a retaining screw by which the heater holder 23 can be positioned in the recess 22. It is essential only that the heater holder 23 is installed for the ease of mounting and dismounting and for maintaining the air-tightness in the passage of the refrigerant.

Figure 11:
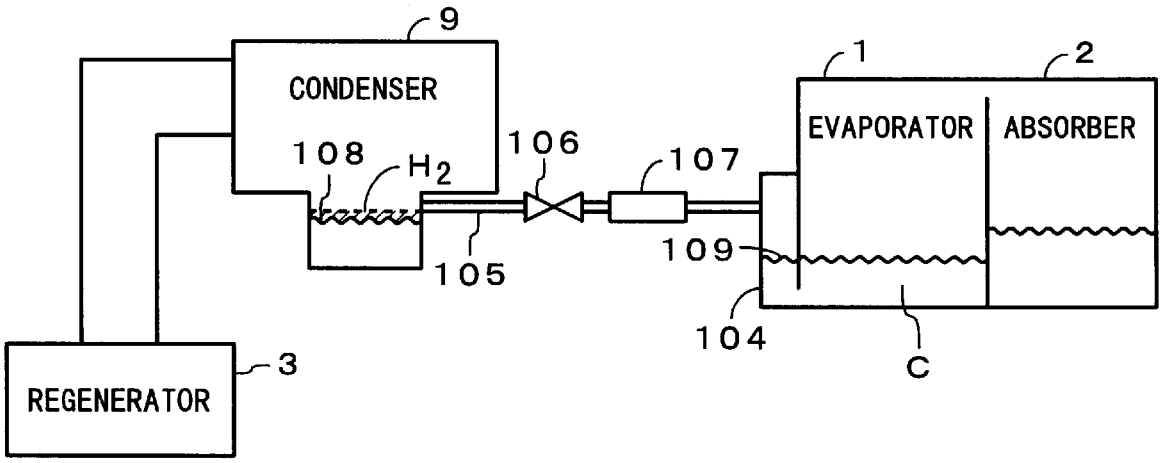
FIG. 11 is a schematic view showing a primary part of an absorption type refrigerator of a third embodiment.

Another placement of the metal oxide is explained. FIG. 11 is a schematic view showing the reduction body located between the condenser 9 and the evaporator 1. As shown, an evaporator tank 104 communicated at its lower region with the evaporator 1 is provided and connected by an extraction pipe (a passage means) 105 to the condenser 9.

The extraction pipe 105 is accompanied with a valve 106 and a metal oxide holder 107 which is the reduction body is mounted between the valve 106 and the evaporator tank 104. It is desired that the extraction pipe 105 is open at both ends slightly above the level surface 108 of the refrigerant in the condenser 9 and the level surface 109 in the evaporator tank 104, respectively.

Figure 12:
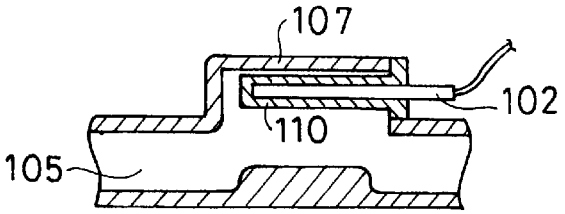
FIG. 12 is a schematic view of a reduction body in the absorption type refrigerator of the third embodiment.

As shown in FIG. 12, the metal oxide holder 107 may have a heater holder 110 for holding a heater 102 arranged to extend into the extraction pipe 105, thus allowing a layer or a film of the metal oxide to form on the outer surface of the heater holder 110.

Referring to FIG. 11, the valve 106 is opened when the hydrogen gas is accumulated over the level surface 108 in the condenser 9 during the operation. This allows the hydrogen gas $H_2$ to run through the valve 106 into the metal oxide holder 107 together with refrigerant vapor because the pressure is higher in the condenser 9 than in the evaporator 1. In the metal oxide holder 107, the hydrogen gas comes into direct contact with the metal oxide heated by the heater 102 and the reduction of the metal oxide produces water and eliminates the hydrogen gas. The remaining of the hydrogen gas which is not eliminated in the metal oxide holder 107 enters the evaporator tank 104 where the level surface of the refrigerant is higher than the passage C between the evaporator tank 104 and the evaporator 1. Accordingly, the hydrogen gas is prevented by the level surface from running further to the evaporator 1 and the absorber 2.

While the system is not running, a control action of returning back the refrigerant to the evaporator 1 also permits the level surface of the refrigerant in the evaporator 1 to be maintained higher than an outlet or the passage C between the evaporator 1 and the evaporator tank 104, hence preventing the hydrogen gas from entering the evaporator 1 and the absorber 2. More particularly, the refrigerant is returned back to the evaporator 1 while the absorbent solution runs back to the regenerator 3. This interrupts the absorption of the refrigerant vapor from the evaporator 1 by the absorber 2. Accordingly, the pressure in the condenser 9 becomes lower than that in the evaporator 1. Then, the opening of the valve 106 allows the refrigerant vapor and the remaining of the hydrogen gas in the evaporator tank 104 to move in a flow to the condenser 9. As a result, in a non-operation mode, the reduction of the metal oxide in the metal oxide holder 107 takes place like during the operation and eliminates the hydrogen gas.

Figure 13:
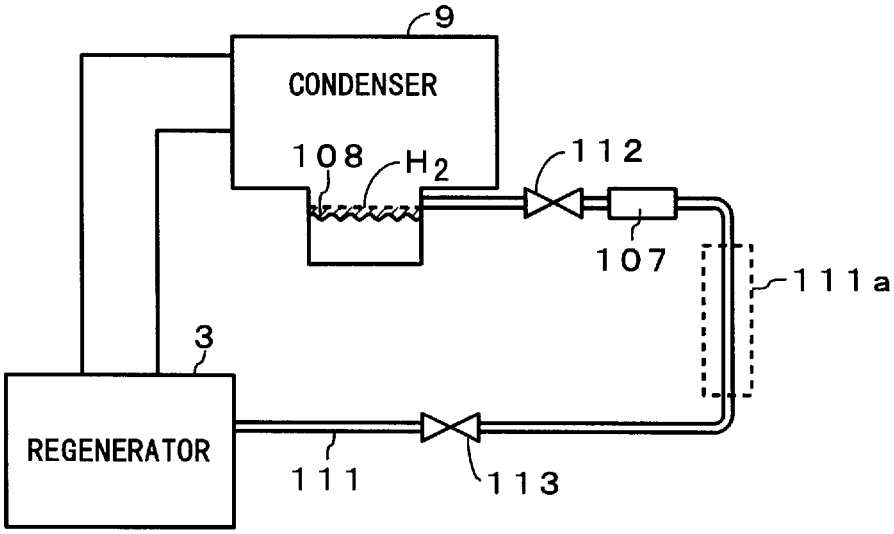
FIG. 13 is a schematic view showing a primary part of an absorption type refrigerator of a fourth embodiment.

A further installation of the reduction body between the condenser 9 and the regenerator 3 is explained referring to FIG. 13. As shown, a couple of valves 112 and 113 are provided at a midway on an extraction pipe 111 (a passage means) which connects between the condenser 9 and the regenerator 3. The reduction body or metal oxide holder 107 is mounted between the two valves 112 and 113. When the hydrogen gas $H_2$ is accumulated in the condenser 9, the valve 112 is opened. This allows the refrigerant vapor to run into the extraction pipe 111 where it is condensed. The supply of the refrigerant vapor and the hydrogen gas is continued until the extraction pipe 111 is filled up with them between the two valves 112 and 113 by the condensation. Then, upon the valve 112 being closed after a predetermined length of time, the hydrogen gas is trapped in the extraction pipe 111 between the two valves 112 and 113 and thus comes into direct contact with the metal oxide stimulating the reduction of the metal oxide. A duration of time from the opening of the valve 112 to the closing of the valve 113 may be controlled by a timer, permitting the valve 113 to be closed automatically.

At the startup of the system, the valve 113 is opened to transfer the condensed refrigerant in the extraction pipe 111 (containing water generated by the reduction) to the regenerator 3. As the refrigerant has been returned back to the regenerator 3, the valve 113 is closed and the hydrogen gas removing apparatus is reset. Although the condensation of the refrigerant is activated by spontaneous radiation of heat from the extraction pipe between the metal oxide holder 107 and the valve 113, it may positively be stimulated with the use of a heat radiating means 111*a*, e.g. a group of cooling fins provided on the extraction pipe.

As set forth above, the present invention involves the reduction of metal oxide to remove hydrogen and generate water. Accordingly, the operation can be maintained at a higher efficiency since the level of vacuum in the refrigerant passages is not declined. Also, as the water generated is not drained out from the system, the content of water in the refrigerant can be maintained to a desired level. Moreover, because the hydrogen gas is directed to the reduction body by the flow of the refrigerant vapor, no pump for extracting the hydrogen gas is needed.

Also, according to the present invention, the hydrogen gas can efficiently be removed from a place where it is notably generated, that is, over the level surface of the refrigerant. As the heater holder with a hydrogen removing agent is tightened by threading to the body of the system, it guarantees a higher level of the air-tightness and can be detached with much ease.

According to the present invention, a high level of the operational efficiency is maintained without declining the level of vacuum in the refrigerant passages while the generated water is not drained out from the system thus to maintain the content of water in the refrigerant to a desired level. Also, the heater can be attached to the heater holder only when needed. The heater holder is so located that its hydrogen removing agent is exposed to the space directly communicated with the refrigerant passage, hence contributing to the minimization of the outwardly projecting region of the system.

What is claimed is:

1. An absorption type refrigerator having an evaporator in which a refrigerant is stored, an absorber for absorbing a refrigerant vapor generated in the evaporator with the use of an absorbent solution, a regenerator for heating the absorbent solution to extract the refrigerant vapor absorbed therein, and a condenser for condensing the refrigerant vapor extracted in the regenerator and returning it to the evaporator, wherein the refrigerant is an alcohol containing refrigerant which includes water for minimizing corrosion to metal and a reduction body is provided which comprises a hydrogen removing agent for generating water in a reduction reaction and a heating means for heating the agent to conduct the reduction of it with hydrogen gas generated during the absorption refrigerating cycles.

2. An absorption type refrigerator according to claim 1, wherein a passage means is provided for transferring the hydrogen gas from the condenser to the reduction body.

3. An absorption type refrigerator according to claim 2, wherein the passage means is opened close to the level surface of the refrigerant in the condenser so as to suck up the hydrogen gas standing over the level surface of the refrigerant.

4. An absorption type refrigerator according to claim 2, wherein a condenser tank is provided which is communicated with the passage means and the reduction body is installed in the condenser tank.

5. An absorption type refrigerator according to claim 2, wherein the passage means is connected to the regenerator and has two valves mounted on a condenser side and a regenerator side thereof respectively while the reduction body is located between the two valves.

6. An absorption type refrigerator according to claim 5, wherein a heat radiating means is provided between the reduction body and the valve on the regenerator side.

7. An absorption type refrigerator according to claim 2, wherein the passage means is connected to one of the evaporator and the absorber and both a valve and the reduction body are mounted on the passage means.

8. An absorption type refrigerator according to claim 2, wherein an evaporator tank is provided which is located adjacent to and fluidly communicated at its lowermost with the evaporator, the passage means is connected to the condenser and the evaporator tank, and both a valve and the reduction body are mounted on the passage means.

9. An absorption type refrigerator according to claim 1, wherein the heating means is detachably mounted to the reduction body.

10. An absorption type refrigerator according to claim 1, wherein the hydrogen removing agent is an oxide of transition metal or a mixture of such transition metal oxides.

11. An absorption type refrigerator according to claim 1, wherein the heating means is of a bar-like shape and a holding means for holding the heating means is provided in the reduction body, which is of a cylindrical shape having one end thereof opened to accept the heating means and an outer side thereof provided with a holding surface for the hydrogen removing agent, and is arranged to expose the hydrogen removing agent to the space directly communicated with the level surface of the refrigerant.

12. An absorption type refrigerator according to claim 11, wherein the holding means has a thread provided therein while a corresponding thread is provided in a component parts which defines a space directly communicated with the level surface of the refrigerant so that the holding means and the component are joined to each other by mating of their threads.

13. An absorption type refrigerator according to claim 11, wherein the space directly communicated with the level surface of the refrigerant is formed in a tank which has a communication opening provided therein to be open over the level surface of the refrigerant in the condenser.

14. An absorption type refrigerator having an evaporator in which a refrigerant is stored, an absorber for absorbing a refrigerant vapor generated in the evaporator with the use of an absorbent solution, a regenerator for heating the absorbent solution to extract the refrigerant vapor absorbed therein, and a condenser for condensing the refrigerant vapor extracted in the regenerator and returning it to the evaporator, characterized in that the refrigerant is an alcohol refrigerant and a reduction body is provided which comprises a hydrogen removing agent to conduct the reduction of it with hydrogen gas generated during the absorption refrigerating cycles.

* * * * *